United States Patent [19]

Yanabu et al.

[11] 4,296,288

[45] Oct. 20, 1981

[54] GAS INSULATED DISCONNECTING SWITCHES

[75] Inventors: Satoru Yanabu, Machida; Hitoshi Mizoguchi; Naoaki Simogawara, both of Yokohama, all of Japan

[73] Assignee: Tokyo Shibaura Denki Kabushiki Kaisha, Kanagawa, Japan

[21] Appl. No.: 87,655

[22] Filed: Oct. 24, 1979

[30] Foreign Application Priority Data

Oct. 30, 1978 [JP] Japan ..... 53-132593

[51] Int. Cl.[3] ..... H01H 33/12; H01H 33/88

[52] U.S. Cl. ..... 200/146 R; 200/148 A

[58] Field of Search ..... 200/146 R, 148 A

[56] References Cited

U.S. PATENT DOCUMENTS 3,801,763 4/1974 Marin ..... 200/146 R 4,086,461 4/1978 Gonek ..... 200/146 R

*Primary Examiner*—Robert S. Macon

*Attorney, Agent, or Firm*—Stevens, Davis, Miller & Mosher

[57] ABSTRACT

In a gas insulated disconnecting switch, a movable contact assembly comprises a stationary cylinder, a coaxial cylindrical movable conductive contact, and a coaxial rod-shaped movable arc electrode. A compression chamber is formed between the stationary cylinder and the movable conductive contact. A damping chamber is formed between the movable conductive contact and the movable arc electrode. Because of controlled flow of gas into and out of these chambers, the speed at which the movable arc electrode is brought into contact with the stationary arc electrode is restricted and possibility of breakage of the arc electrodes is eliminated.

3 Claims, 6 Drawing Figures

GAS INSULATED DISCONNECTING SWITCHES

BACKGROUND OF THE INVENTION

The present invention relates to a gas insulated disconnecting switch, which is particularly suitable for use in a gas insulated switching apparatus.

One of the problems associated with a disconnecting switch filled with such insulating gas as $SF_6$ is the breakage of the tips of the stationary and movable contacts or electrodes due to impact created at the time of closing the disconnecting switch.

Another problem has arisen as a disconnecting switch is used, for instance, for switchover in a transmission system shown in FIG. 1. For effecting switchover from one transmission line A to another B, a disconnecting switch BD is closed and a disconnecting switch AD is then opened. The disconnecting switch AD has to interrupt its share of the load current, with the recovery voltage being determined by the voltage drop across the disconnecting switch BD and the associated transmission line. Such current may be near the magnitude of the rated current, if difference in resistance between the lines A and B is great.

If an arc proof piece of copper-tungsten alloy is mounted on the end of each contact to improve resistance against impact, powder of decomposition product formed of the vaporized alloy and the decomposed constituent of the $SF_6$ gas is deposited on an insulating spacer, with the result that insulating strength is lowered.

SUMMARY OF THE INVENTION

An object of the invention is to provide a gas insulated disconnecting switch capable of avoiding breakage of the contacts.

Another object of the invention is to provide an improved disconnecting switch capable of avoiding deterioration of the insulating strength of the disconnecting switch.

According to the invention, there is provided a gas insulated disconnecting switch comprising:

(A) a stationary contact assembly including:

a substantially rod-shaped stationary arc electrode, and a stationary conductive contact, and (B) a movable contact assembly provided to confront the stationary contact assembly and including:

a stationary cylinder having an annular end plate extending inwardly from the stationary cylinder, a cylindrical movable conductive contact coaxial with the stationary cylinder and having a piston extending outwardly from the movable conductive contact at a position farther from the stationary contact assembly than the end plate of the stationary cylinder, the piston slidably and gas-tightly engaging the inner surface of the stationary cylinder, the end plate of the stationary cylinder slidably and gas-tightly engaging the outer surface of the movable conductive contact to form a compression chamber between the end plate and the piston and between the stationary cylinder and the movable conductive contact, and the movable conductive contact further having an annular stopper extending inwardly from the movable conductive contact, a substantially rod-shaped movable arc electrode coaxial with the stationary cylinder and having a piston extending outwardly from the movable arc electrode at a position farther from the stationary contact assembly than the stopper of the movable conductive contact, the piston of the movable arc electrode slidably and gas-tightly engaging the inner surface of the movable conductive contact, the stopper of the movable conductive contact slidably and gas-tightly engaging the outer surface of the movable arc electrode to form a damping chamber between the stopper and the piston of the movable arc electrode and between the movable conductive contact and the movable arc electrode, and the movable conductive contact being provided with a perforation providing communication between the compression chamber and the damping chamber, the perforation being so positioned and sized that it extends, when the movable conductive contact is in engagement with the stationary conductive contact, over both sides of the end plate to provide communication between the two chambers and the exterior of the chambers, and, a spring engaging at one end with the movable conductive contact and at the other end with the movable arc electrode in such a manner that when the movable conductive contact is moved toward the stationary conductive contact the spring urges the movable arc electrode toward the stationary arc electrode, said stopper having a projection projecting toward the piston of the movable arc electrode to engage with and push said piston of the movable arc electrode when the movable conductive contact is separated from the stationary conductive contact.

DETAILED DESCRIPTION OF THE PREFERRED EMBODIMENT

Figure 1:
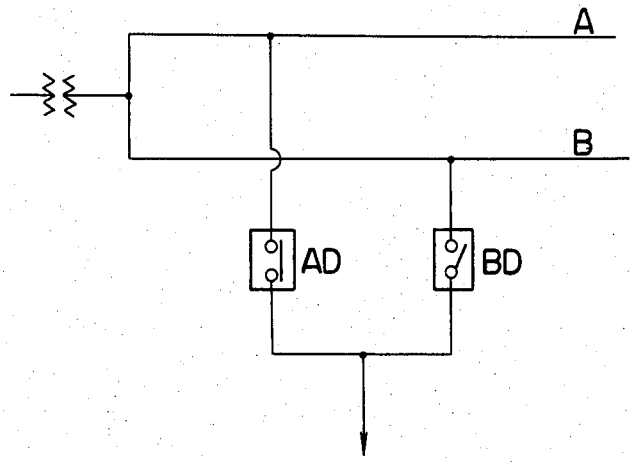
FIG. 1 is a diagram showing how gas insulated disconnecting switches are used for effecting switchover between two transmission lines.
Figure 2:
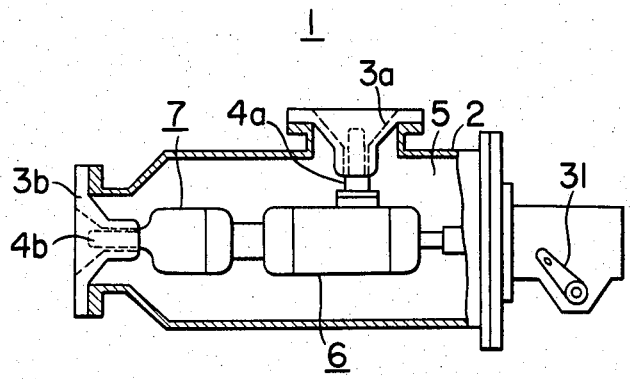
FIG. 2 is a partially broken sectional view showing an embodiment of a gas insulated disconnecting switch according to the invention.

Referring now more particularly to FIG. 2, there is shown an embodiment of a gas insulated disconnecting switch 1, which comprises a grounded and sealed tank 2 filled with $SF_6$ gas. Provided in the tank 2 are a movable contact assembly 6 and a stationary contact assembly 7, which are positioned to confront each other and secured by means of insulating spacers 3*a* and 3*b*, to the tank 2.

Supporting conductors 4*a* and 4*b* are provided to electrically connect the movable and stationary contact assemblies to external equipments or bus bars.

Figure 3:
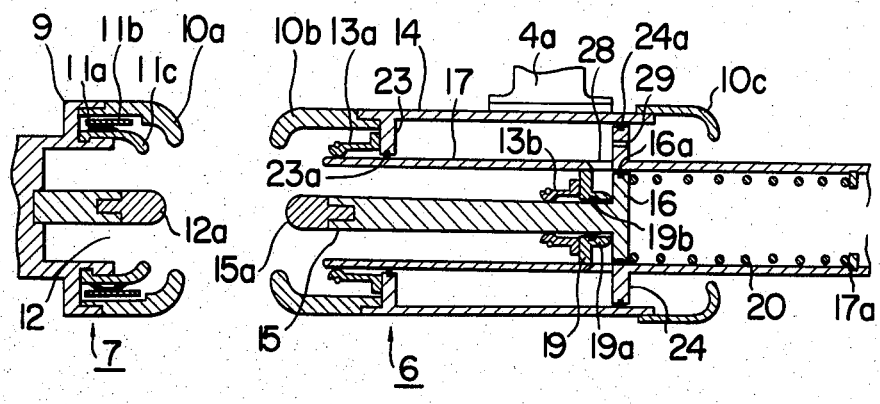
FIGS. 3 through 6 are longitudinal sectional views showing, in an enlarged scale, the stationary contact assembly and the movable contact assembly of the gas insulated disconnecting switch shown in FIG. 2, the movable contact assembly being shown at different operating positions.

As illustrated in FIG. 3, the stationary contact assembly 7 comprises a stationary conductive contact 11*c* which is inwardly pressed by a spring 11*a* supported by a spring holder 11*b*, a shield 10*a* formed of a carbonaceous material, such as graphite, and a rod-shaped movable arc electrode 12 provided with, at its end, an arc-proof piece 12*a* formed of a carbonaceous material, such as graphite. The shield 10*a* and the arc electrode 12*a* are secured to a contact base 9. The shield 10*a* encircles those portions of the stationary arc electrode 12*a* and the stationary conductive contact 11*c* which are close to the movable contact assembly 6 and projects beyond the stationary arc electrode 12*a* and the stationary conductive contact 11*c* toward the movable contact assembly 6.

The movable contact assembly 6 comprises a stationary cylinder 14 having, at its end, a shield 10*b* of a carbonaceous material, such as graphite. The cylinder 14 is mounted to a conductor 4*a*. The cylinder 14 is provided with an annular end plate 23 extending inwardly from the cylinder 14. A cylindrical movable conductive contact 17 is provided coaxially with the cylinder 14 and has a piston 24 extending outwardly from the movable conductive contact 17 at a position farther than the end plate 23 from the stationary contact assembly 7. The piston 24 slidably and gas-tightly engages, by means of a slide ring 24*a*, the inner surface of the cylinder 14, while the end plate 23 slidably and gas-tightly engages, by means of a slide ring 23*a*, the outer surface of the movable conductive contact 17. Thus, a compression chamber 26 is formed between the end plate 23 and the piston 24 and between the cylinder 14 and the movable conductive contact 17. The movable conductive contact 17 is coupled by an insulating rod, not shown, to an external driving mechanism through a link 31.

A current collector contact 13*a* is mounted to the end plate 23 of the cylinder 14 to collect the current from the movable conductive contact 17. Extending inwardly from the innner surface of the movable conductive contact 17 is a stopper 19, to which another current collector contact 13*b* is fixed.

A rod-shaped movable arc electrode 15 is provided coaxially with the cylinder 14, and has, at one of its ends, an arc proof piece 15*a* of a carbonaceous material, such as graphite. The other end of the movable electrode 15 is provided with a piston 16 extending outwardly from the movable arc electrode 15. Thus, the piston 16 is positioned farther from the stationary contact assembly 7 than the stopper 19. The piston 16 slidably and gas-tightly engages, by means of a slide ring 16*a*, the inner surface of the movable conductive contact 17, while the stopper 19 slidably and gas-tightly engages, by means of a slide ring 19*b*, the outer surface of the movable arc electrode 15. Thus, a damping chamber 27 is formed between the stopper 19 and the piston 16 and between the movable conductive contact 17 and the movable arc electrode 15.

The current collector contact 13*b* collects the current from the movable arc electrode 15.

The movable conductive contact 17 is provided with perforations 28 positioned adjacent to the piston 24 and providing communication between the compression chamber 26 and the damping chamber 27. The perforations 28 have such length that provides, when the movable conductive contact 17 is in engagement with the stationary conductive conduct, communication between the chambers 26 and 27, and the exterior of the chambers. The piston 24 is provided with one or more openings 29. The size and the number of the openings may be adjusted to provide optimum damping effect on the movable arc electrode 15.

A spring 20 is provided between a spring seat 17*a* provided on the inner surface of the conductive contact 17 and the piston 16 in such a manner that when the movable conductive contact 17 is moved toward the stationary conductive contact 11*c*, the spring 20 urges the movable arc electrode 15 toward the stationary arc electrode 12*a*.

The stopper 19 has a projection 19*a* projecting toward the piston 16 to engage with and push the piston 16 when the movable conductive contact 17 is separated from the stationary conductive contact 11*c*.

The shield 10*b* encircles, when the disconnecting switch 1 is in open condition, those portions of the movable arc electrode 15 and the movable conductive contact 17 which are close to the stationary contact assembly 7 and projects, when the disconnecting switch 1 is in open condition, beyond the movable arc electrode 15 and the movable conductive contact 17.

The slide rings 16*a*, 19*b*, 23*a*, 24*a* may be formed of a plastic material such as polytetrafluoro ethylene. When an insulating material is used for the slide rings, the slide rings also provide electrical insulation.

Figure 4:
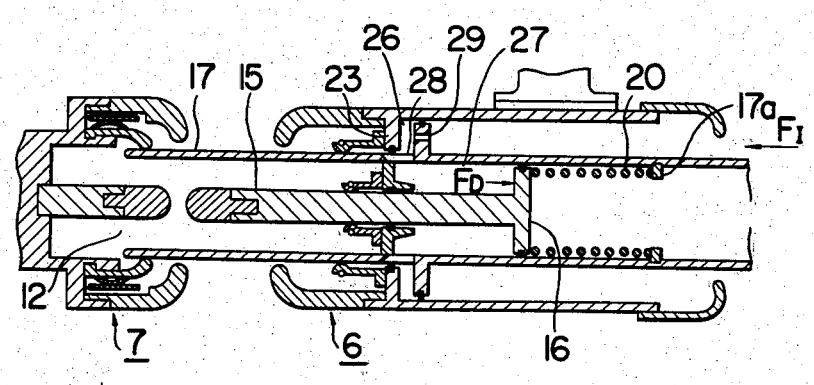
Figure 5:
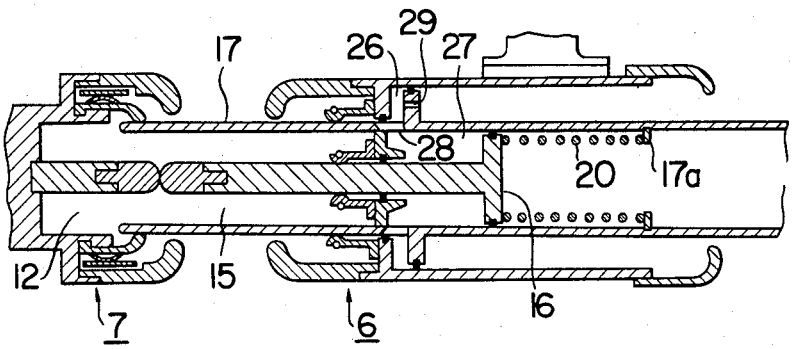

In FIG. 4, closing force $F_I$ is being exerted and the movable conductive contact 17 is in a position just before it reaches the engaged position. As the movable conductive contact 17 is moved from the position shown in FIG. 3 to the position shown in FIG. 4, the gas pressure in the compression chamber 26 is increased and the gas flows through the perforations 28 into the damping chamber 27. Accordingly, a damping force $F_D$ acts on the movable arc electrode 12 overcoming the force exerted by the spring 20 so that the movable arc electrode 15 is moved relative to the movable conductive contact 17 in the direction of $F_D$. In the state shown in FIG. 4, the movable arc electrode 15 is spaced by a suitable gap from the stationary arc electrode 12.

After that, gas flows through the perforations 28, an opening 29, and gaps between the slide rings and the engaging surfaces, out of the compression chamber 26 and the damping chamber 27 so that the gas pressure in these chambers is gradually decreased and the damping force $F_D$ is gradually decreased. When the damping force $F_D$ is overcome by the force of the spring 20, the movable electrode 15 is slowly moved toward and brought into contact with the stationary arc electrode 12. Since the speed at which the movable arc electrode 15 is brought into contact with the stationary arc electrode 12 is low, impact on the arc proof pieces 12*a* and 15*a* is small and hence possibility of breakage thereof is eliminated.

Figure 6:
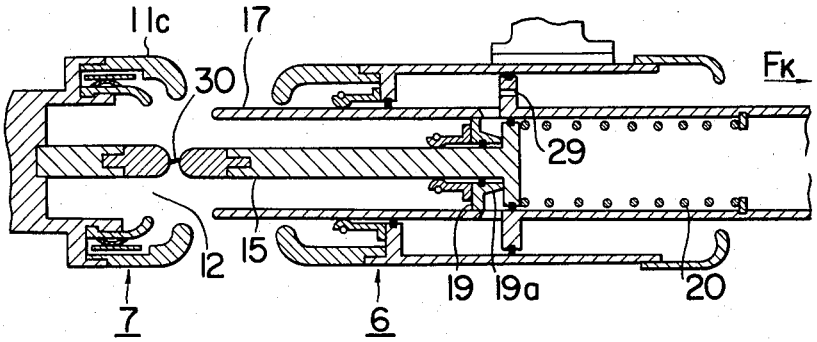

When, as illustrated in FIG. 6, a separating force $F_K$ is exerted on the movable conductive contact 17, it is separated from the stationary conductive contact 11*c*, but the contact between the stationary and movable arc electrodes 12 and 15 is maintained because of the force due to the spring 20. When the stationary and movable conductive contacts 11*c* and 17 are separated from each other by a sufficient insulating distance, the piston 16 of the movable arc electrode 15 is pushed by the projection 19*a* of the stopper 19, and the movable arc electrode 15 is separated from the stationary arc electrode 12 and the arc is generated across the arc proof pieces 12*a* and 15*a*. If the arc across the arc proof pieces 12*a* and 15*a* is not extinguished before the movable arc electrode is retracted to a position shown in FIG. 3, the arc may occur across the shields 10*a* and 10*b*. The arc causes the carbonaceous material to evaporate. The evaporated carbon is combined with fluorine in the $SF_6$ gas to result in a decomposition product $CF_4$. But as the product $CF_4$ is gaseous, no powder or deposit is produced, so that no deterioration of the insulating strength occurs. This is in contrast to the case where arc proof pieces of copper-tungsten alloy are used.

What is claimed is:

1. A gas insulated disconnecting switch comprising:

(A) a stationary contact assembly including:

a substantially rod-shaped stationary arc electrode, and a stationary conductive contact, and (B) a movable contact assembly provided to confront said stationary contact assembly and including:

a stationary cylinder having an annular end plate extending inwardly from said stationary cylinder, a cylindrical movable conductive contact coaxial with said stationary cylinder and having a piston extending outwardly from said movable conductive contact at a position farther from said stationary contact assembly than said end plate of said stationary cylinder, said piston slidably and gastightly engaging the inner surface of said stationary cylinder, said end plate of said stationary cylinder slidably and gas-tightly engaging the outer surface of said movable conductive contact to form a compression chamber between said end plate and said piston and between said stationary cylinder and said movable conductive contact, and said movable conductive contact further having an annular stopper extending inwardly from said movable conductive contact, a substantially rod-shaped movable arc electrode coaxial with said stationary cylinder and having a piston extending outwardly from said movable arc electrode at a position farther from said stationary contact assembly than said stopper of said movable conductive contact, said piston of said movable arc electrode slidably and gas-tightly engaging the inner surface of said movable conductive contact, said stopper of said movable conductive contact slidably and gas-tightly engaging the outer surface of said movable arc electrode to form a damping chamber between said stopper and said piston of said movable arc electrode and between said movable conductive contact and said movable arc electrode, and said movable conductive contact being provided with a perforation providing communication between said compression chamber and said damping chamber, said perforation being so positioned and sized that it extends, when said movable conductive contact is in engagement with said stationary conductive contact, over both sides of said end plate to provide communication between the two chambers and the exterior of the chambers, and, a spring engaging at one end with said movable conductive contact and at the other end with said movable arc electrode in such a manner that when said movable conductive contact is moved toward said stationary conductive contact said spring urges said movable arc electrode toward the stationary arc electrode, said stopper having a projection projecting toward said piston of said movable arc electrode to engage with and push said piston of said movable arc electrode when said movable conductive contact is separated from said stationary conductive contact.

2. A gas insulated disconnecting switch according to claim 1, wherein said stationary and movable arc electrodes are respectively provided with arc proof pieces of a carbonaceous material at those ends which are engageable with each other.

3. A gas insulated disconnecting switch according to claim 1, wherein said stationary contact assembly further comprises a shield of a carbonaceous material encircling those portions of said stationary arc electrode and said stationary conductive contact which are close to said movable contact assembly and projecting further than said stationary arc electrode and said stationary conductive contact toward said movable contact assembly, and said movable contact assembly further comprises a shield of a carbonaceous material encircling, when the disconnecting switch is in open condition, those portions of said movable arc electrode and said movable conductive contact which are close to said stationary contact assembly and projecting, when the disconnecting switch is in open condition, further than said movable arc electrode and said movable conductive contact toward said stationary contact assembly.

* * * * *